US006805193B2

(12) United States Patent
Hu et al.

(10) Patent No.: US 6,805,193 B2
(45) Date of Patent: Oct. 19, 2004

(54) FIN LOUVER DESIGN FOR HEAT EXCHANGER

(75) Inventors: Zaiqian Hu, Columbus, IN (US); Philippe Le Gauyer, Paris (FR); Lei Fang, West Lafayette, IN (US)

(73) Assignee: Valeo, Inc., Auburn Hills, MI (US)

( * ) Notice: Subject to any disclaimer, the term of this patent is extended or adjusted under 35 U.S.C. 154(b) by 184 days.

(21) Appl. No.: 10/053,670

(22) Filed: Jan. 24, 2002

(65) Prior Publication Data

US 2003/0136554 A1 Jul. 24, 2003

(51) Int. Cl.[7] ..... F28F 1/20
(52) U.S. Cl. ..... 165/181; 165/152; 165/DIG. 503
(58) Field of Search ..... 165/151, 152, 165/153, 181

(56) References Cited

U.S. PATENT DOCUMENTS 6,543,527 B1 * 4/2003 Bouzida et al. ..... 165/152

* cited by examiner

*Primary Examiner*—Ljiljana Ciric
(74) *Attorney, Agent, or Firm*—Liniak, Berenato & White

(57) ABSTRACT

A fin louver design using breaking and reversal louvers whose lengths are substantially longer than the half-length of the main louver but at slightly lower angles to the fin face, in order to increase the heat transfer while reducing or minimizing the airside air pressure drop. The reversal louvers will not dramatically change the airflow direction but rather permit air to follow the louver direction, thus preventing any dead area where the air speed is approximately zero in the central part between the two reversal louvers. Contact is provided between fresh moving air and the central part between the two reversal louvers.

7 Claims, 4 Drawing Sheets

FIN LOUVER DESIGN FOR HEAT EXCHANGER

BACKGROUND OF THE INVENTION

1. Field of the Invention

The present invention provides an improved fin design and, more particularly, provides an optimized fin design in order to increase the heat transfer while reducing or minimizing any airside air pressure drop.

2. General State of the Art Mod Pertinent to Invention

Air-cooled heat exchangers are used extensively by the automotive industry. In such an exchanger, the tubes carry the coolant, refrigerant, oil or hot air to be cooled. Fins are added to the outside of the tube to increase the contact surface area between the heat exchanger tubes and the outside air flowing across them. The air has thermal conductivity and convection coefficients that are very low. Louvers can be added to the fins in order to enhance the airside thermal efficiency and can significantly increase heat transfer by reducing the thermal resistance.

Each fin cross section has at least one set of louvers having two blocks. Each louver set usually has the forward and rearward blocks symmetrical to each other about the center of the set. Each block has a breaking (first) louver 1, one or several normal (main) louvers 2 and a reversal (center or last) louver 3 and may also have a center neutral (flat) area 4 as shown in FIG. 1. Traditionally, the breaking louver and the reversal louver have a shorter width than the normal louvers, in order to give more space to increase the number of normal louvers.

Another louver design can also be used such as the one shown in FIG. 2. In this louver block the reversal louver has the same width 'w' as the normal louvers but does not have a central flat area, such as is shown in FIG. 1. Still other louver designs have both full width breaking and reversal louvers, as well as the central flat area, such as are shown in the FIG. 3.

Despite the advantages of each of these different louver designs, they all have some drawbacks. The louver block design in FIG. 2 is deficient because the two reversal louvers dramatically change the airflow direction. Air cannot follow the louver direction, resulting in dead area where the air speed is approximately zero in the central part between the two reversal louvers. As a result, there is no contact between "fresh moving" air and the central part between the two reversal louvers.

The louver in FIG. 1 brings in some improvement by adding central flat area, allowing air to flow along the profile of louver, hence increasing the contact between the "fresh moving" air and the inside of the center neutral area between the two reversal louvers. However, because both the breaking and reversal louvers have reduced louver width, their primary function of directing air in through the louvers is compromised. This is particularly true for the case where the core depth of heat exchanger is very limited to approximately 30 mm or less, which covers many of the automotive applications. In these cases, each block has only few main louvers. If air does not flow in a direction along the main louvers, after the breaking or reversal louver, then these few main louvers lose their efficiency.

A fin with louvers such as those shown in the FIG. 3 solved this issue by using full width breaking and reversal louvers, as well as central flat area. However, it creates a new problem. In fact as shown in the FIG. 3, the full width breaking and reversal louvers block the airflow direction to some extent. This design creates a much higher air-side pressure drop, which in turn reduces the overall air-side heat transfer for a given "ram" air intake or for a given fan air flow capability.

SUMMARY OF THE INVENTION

The object of the present invention is to overcome the drawbacks inherent in the prior art because the reversal louvers will not dramatically change the airflow direction but rather permit air to follow the louver direction, thus preventing any dead area where the air speed is approximately zero in the central part between the two reversal louvers. The present invention provides a contact between fresh moving air and the central part between the two reversal louvers.

It is a further object of the invention to minimize air-side pressure drop, thereby preventing reduction in the overall air-side heat transfer for a given "ram" air intake or for a given fan air flow capability.

The invention optimizes the fin design using breaking and reversal louvers whose lengths are substantially longer than the half-length of the main louver but at slightly lower angles to the fin face, in order to increase the heat transfer while reducing or minimizing the airside air pressure drop.

DETAILED DESCRIPTION OF THE PREFERRED EMBODIMENTS

Figure 4:
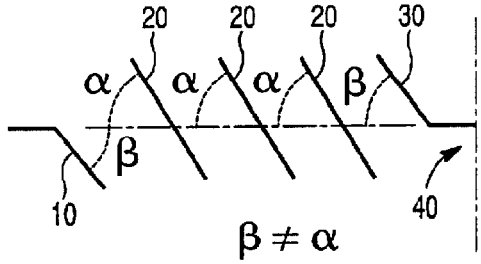
FIG. 4 illustrates a fin louver block showing lower angle full-length breaking louver, main louvers and lower angle full-length reversal louver with a neutral flat center area in accordance with this invention.

FIG. 4 presents the basic idea of this invention. Each of the fin louver blocks has a breaking louver 10, several full louvers 20, and a reversal louver 30. There is a flat area 40 between the two reversal louvers. The lengths of breaking louver and/or the reversal louver are significantly wider than half of the width of other normal louvers (in the FIG. 4 where both breaking and reversal louvers have the same width as other louvers).

One key feature of this new design here is the angle of the breaking louver and that of reversal louver. In order to reduce the blockage effect of the air passage, the angle of breaking lower and that of the reversal louver are less than that of normal louvers. At the same time, they are bigger than one third of the angle of normal louvers. In the example shown in the F FIG. 6, the angle of breaking louver equals that of the reversal louver. However, that is just one option available to one skilled in the art considering the benefits and advantages provided by this unique design.

In the simulation provided herein, the number of louvers was reduced by 1 on each block of louvers in order to use full-louver length breaking and reversal louvers. In this way, the total fin width is kept the same. In order to compare to the original louver configuration (2 half louvers for the breaking and reversal louvers), the heat transfer and air pressure drop values of the original louver configuration were put to one (1) to normalize the heat transfer and air pressure drop results.

Figure 5:
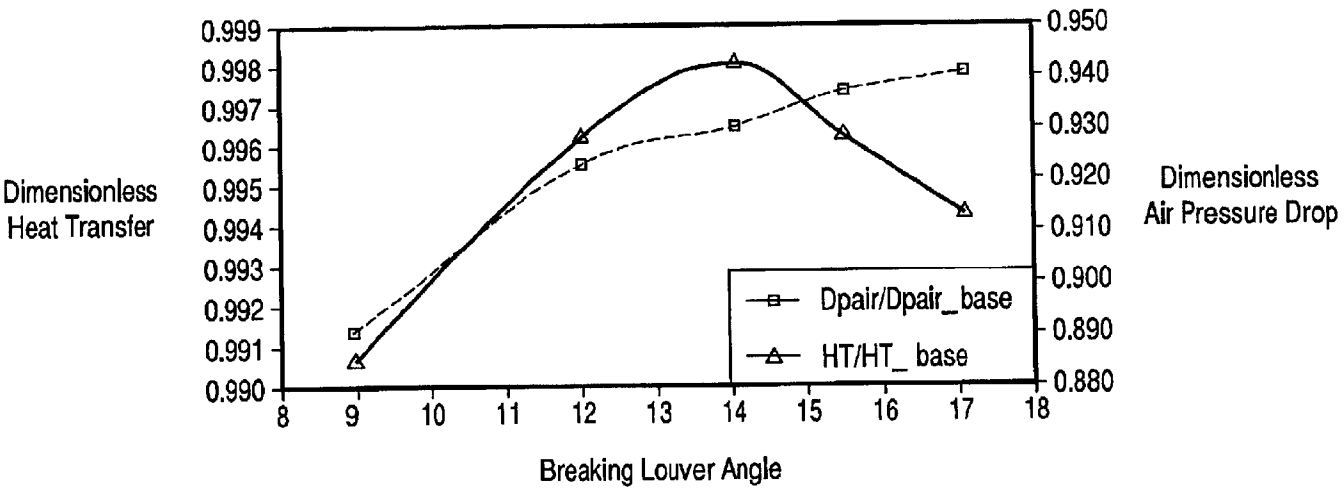
FIG. 5 illustrates a heat transfer and delta pressure drop chart using various angles of a full length breaking louver, 17' angle main louvers and various angle, of a full length reversal louver with a neutral flat center area.

FIG. 5 shows CFD results of the influence of the angle of breaking louver (reversal louver) on the heat transfer and air pressure drop. In this case, the angle of normal louvers is 17 degrees, and fin-pitch/louver-width ratio equals 0.9. When the angle of the breaking louver is close to ½ of normal louver angle (e.g., ~8.5°), the heat transfer is down compared to the original louver configuration. At the same time, the air pressure drop is also reduced. When the angle of breaking louver is increased, the heat transfer reduction is reduced, and this trend continues until 14 degree where the heat transfer reduction is extremely small. Any further increase of the angle of breaking louver will increase the heat transfer reduction, as well as air pressure drop. Therefore, there is an optimal range of angle of breaking louver within which the heat transfer reduction is almost non-existent, and at the same time, we get significant reduction in air pressure drop (this case 6%).

Figure 6:
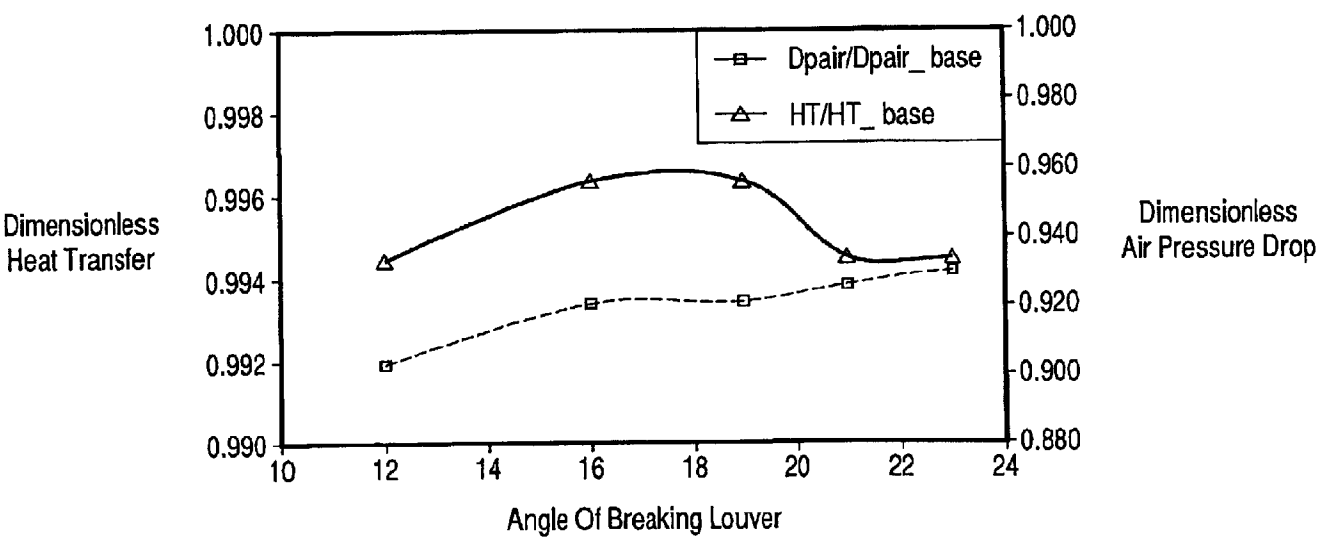
FIG. 6 illustrates a heat transfer and delta pressure drop chart using various angles of a full length breaking louver, 23° angle main louvers and various angles of a full length reversal louver with a neutral flat center area.

FIG. 6 gives another example of optimization of breaking louver angle. When the angle of normal louvers is 23 degrees, fin pitch/louver width ratio equals 1.1, one can see from the chart of FIG. 6 that the optimized range of breaking louver angle is between 16–19 degrees, where the reduction in heat transfer is only about 0.4%; however, the reduction in air pressure drop is about 4–5%.

In general, we found that the λ (ratio of angle of breaking louver over the angle of normal louver) should be within the following range:

$$0.5 \leqq \lambda \leqq 0.95$$

in order to get the optimized heat transfer and air pressure drop. And the best angle range is very close between 0.7 and 0.85.

Figure 1:
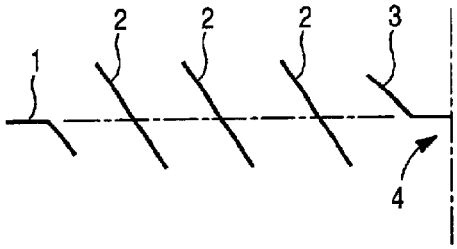
FIG. 1 illustrates a conventional fin louver block showing a short common angle breaking louver with common angle main louvers, a short common angle reversal louver and a neutral flat center area.
Figure 2:
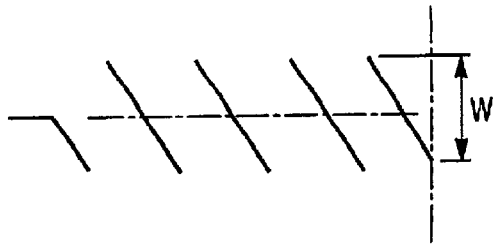
FIG. 2 illustrates a conventional fin louver block showing a short breaking louver with common angle main louvers, a common angle full length reversal louver with no neutral flat center area.
Figure 3:
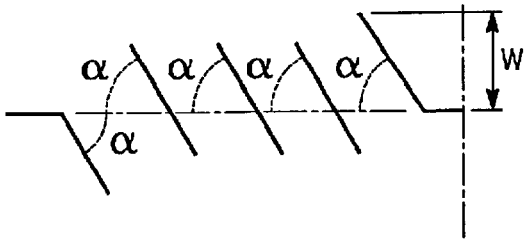
FIG. 3 illustrates a conventional fin louver block showing common angle full-length breaking louver, common angle main louvers and common angle full-length reversal louver with a neutral flat center area.

Of course, this idea should be combined with the use of a central flat part, as shown in the FIG. 1.

In order to generalize the above results, a factor δ is introduced to define the ratio of reduction of free air passage by the full length breaking and reversal louver, in order to take into account of air pressure drop. With the half length breaking and reversal louver, the free air passage A is Fp−Lp sin(α); where α is the angle of normal louvers; Fp is fin pitch, and Lp is louver width.

With the full length breaking and reversal louver and central flat area, the free air passage area is:

$$A = Fp - \max(Lp\sin(\alpha), 2Lp\sin(\beta));$$

where β is the angle of breaking and reversal louver.

Therefore, the factor δ is defined as:

(equation 1)

$$\begin{aligned}\delta &= (Fp - \max(Lp\sin(\alpha), 2Lp\sin(\beta)) / (Fp - Lp\sin(\alpha)) \\ &= (1 - Lp/Fp\max(\sin(\alpha), 2\sin(\beta)) / (1 - Lp/Fp\sin(\alpha))\end{aligned}$$

Figure 8:
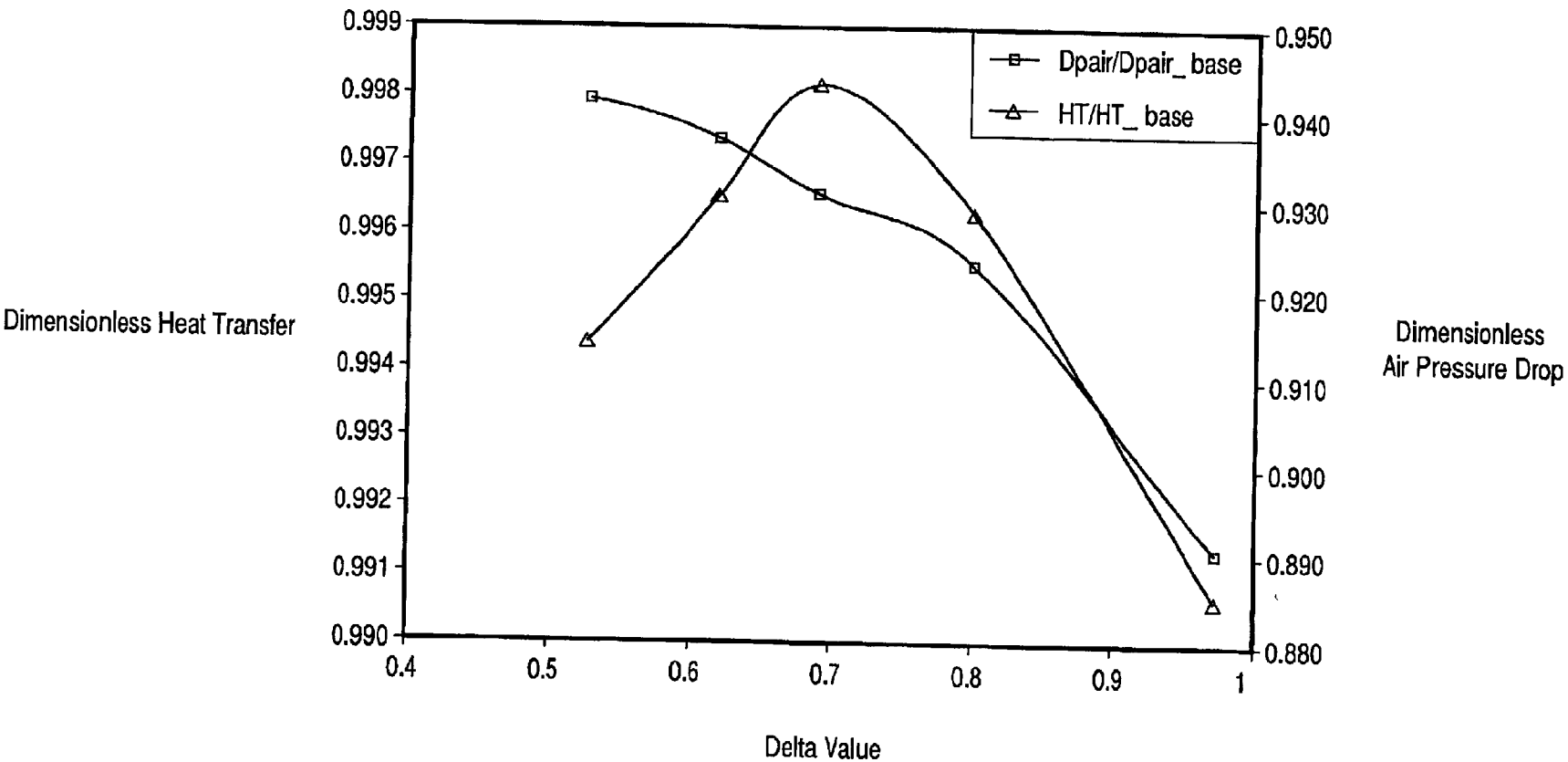
FIGS. 8 and 9 shows the optimum range of parameters based on the results of computational fluid dynamics (CFD) in terms of δ: $0.51 \leqq \delta \leqq 0.96$.
Figure 9:
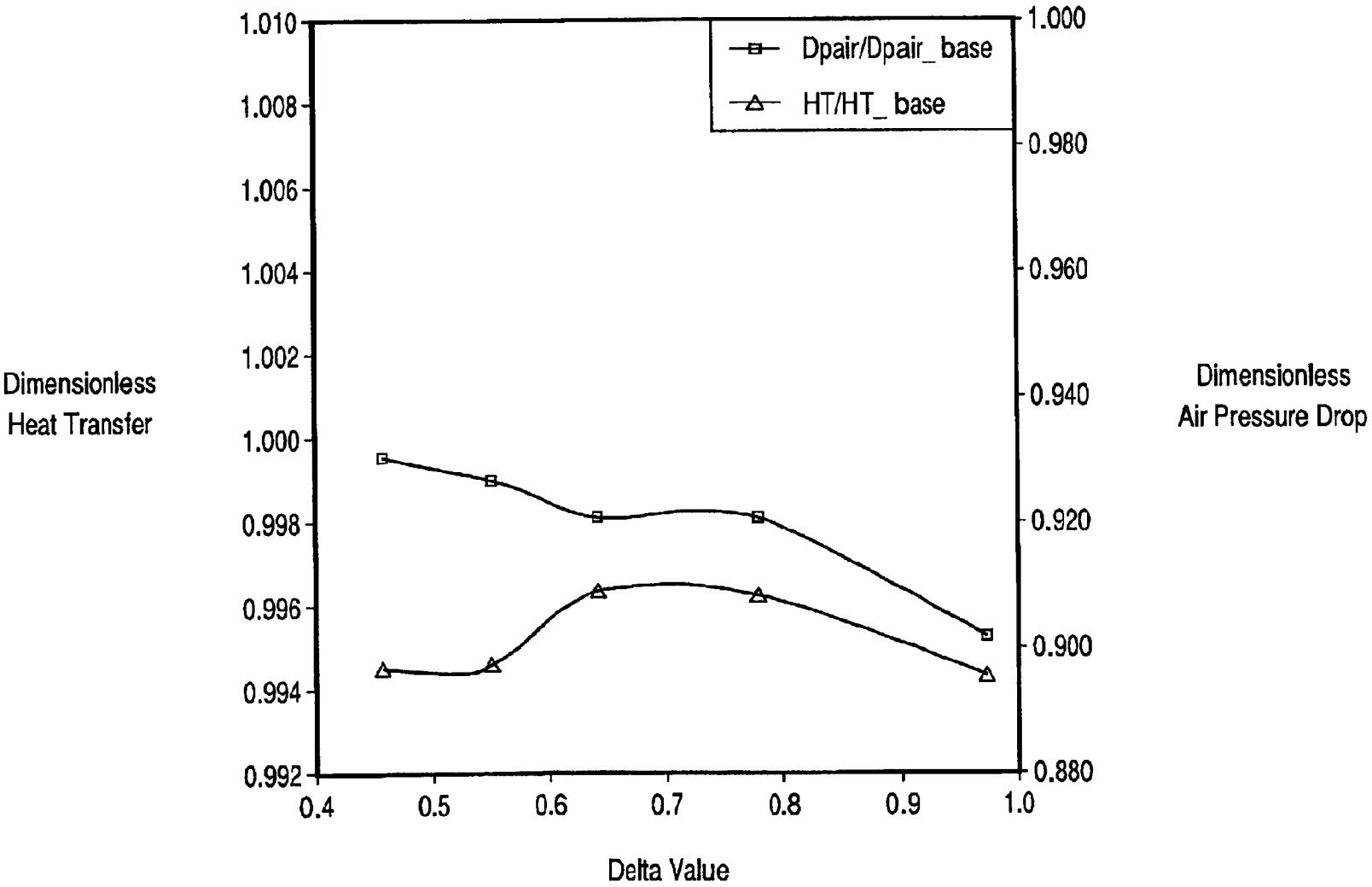

With this definition, it is possible to re-formulate the optimum range of parameters based on the results of CFD in terms of δ:

$$0.51 \leqq \delta \leqq 0.96, \qquad \text{(equation 2)}$$

as shown in the FIGS. 8 and 9.

And its best range is between 0.55 and 0.75.

In more general terms where the length of breaking louver or reversal louver is Lpb and the angle of breaking louver is βb, the angle of the reversal louver is βr, it is possible to define δb, for the breaking louver as, (equation 3)

$$\begin{aligned}\delta r &= \left(Fp - \max(Lp\sin(\alpha), 2Lpb\sin(\beta r))/(Fp - Lp\sin(\alpha))\right. \\ &= \left(1 - Lp/Fp\max\left(\sin(\alpha), 2Lpb\sin(\beta r)(Lp)\left(1 - Lp/Fp\sin(\alpha)\right)\right.\right.\end{aligned}$$

It is also possible to define δr, for the reversal louver as, (equation 4)

$$\begin{aligned}\delta r &= \left(Fp - \max(Lp\sin(\alpha), 2Lpb\sin(\beta r))/(Fp - Lp\sin(\alpha))\right. \\ &= \left(1 - Lp/Fp\max\left(\sin(\alpha), 2Lpb\sin(\beta r)(Lp)\left(1 - Lp/Fp\sin(\alpha)\right)\right.\right.\end{aligned}$$

And equation 1 is the special case for the equations 3 and 4 where Lpb=Lp and βb=βr=β.

Figure 7:
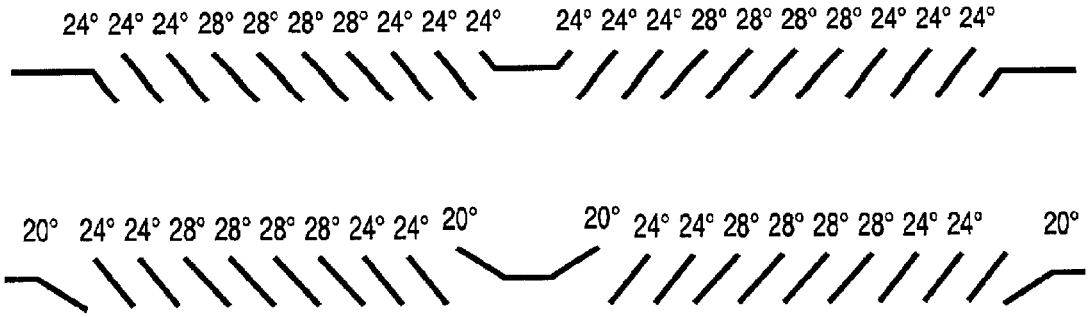
FIG. 7 illustrates a "base" fin model (upper fin pattern) and an "improved" fin model (lower tin pattern) built into heat exchangers for heat transfer testing. The "base" fin louver set using a 24° angle short length breaking louver, 24°/28°/24° angle main louvers and 24° angle short length reversal louver with a neutral flat center area. The "improved" fin louver set using a 20° angle full-length breaking louver. 24°/28°/24° angle main louvers and 20° angle short length reversal louver with a neutral flat center area.

The following table shows test results comparing two louver configurations shown in the FIG. 7.

| | Heat Transfer | | Air pressure drop | |
|---|---|---|---|---|
| | Two semi-lenth louver configuration δ = 1.0 | Full length breaking & reversal louver δ = 0.59 | Two semi-length louver configuration δ = 1.0 | Full length breaking & reversal louver δ = 0.59 |
| Vair = 2.5 m/s | Base | −0.7% | Base | −7.8% |
| Vair = 4.0 m/s | Base | −1.2% | Base | −10% |

These experimental results confirm our CFD results, and support the validity of the equation 2.

The reason for this improvement is as follows. By using full length breaking and reversal louvers, air is better guided to flow into the louver direction. And this is true not only for the first louver block, but also for the second louver block. Therefore, heat transfer is significantly enhanced. Since the invention keeps the same fin width, it reduced one fin louver on each louver block. This reduction in number of louver results in lower pressure drop, as well as reduction in heat transfer. Therefore, combining the two factors lead to same heat transfer, and significantly reduced air pressure drop.

While the instant invention has been shown and described with reference to several preferred embodiments and features, it will be understood by those of skill in the art that various changes in form and detail may be made therein without departing from the spirit and scope of the claimed invention.

What is claimed:

1. A fin system having at least one louver set used to enhance the transfer of heat from a first medium to a second medium, said louver set comprising:

at least two blocks of louvers, each block having a first breaking louver, at least one main louver and a reversal louver and between the central reversal louvers is a flat area, wherein at least one of the first length of said first breaking louver and the second length of the reversal louver is substantially wider than half of the length of the at least one main louver as measured across flat areas of the first breaking louver, the reversal louver and the main louver, and wherein said at least one of said first and second lengths whose length substantially wider than half of the length of the main louver has an angle of orientation, said angle of orientation is lower than a second angle of orientation of the main louver when measured relative to a fin face from which the louvers protrude, and wherein at least one of said two blocks of louvers contains a breaking louver and a reversal louver having a different angle relative to the fin face.

2. The fin system as recited in claim 1, wherein the breaking louver is wider than half of the main louver and has an angle of orientation relative to the main fin face such that the factor of ratio of reduction of free air passage is between 0.51 and 0.96.

3. The fin system as recited in claim 2, wherein the factor of ratio of reduction of free air passage is between 0.55 and 0.75.

4. The fin system as recited in claim 1, wherein the reversal louver is wider than half of the main louver and has an angle of orientation relative to the main fin face such that the factor of ratio of reduction of free air passage is between 0.51 and 0.96.

5. The fin system as recited in claim 4, wherein the factor of ratio of reduction of free air passage is between 0.55 and 0.75.

6. The fin system as recited in claim 1, wherein at least one of said two blocks of louvers contains a breaking louver and a reversal louver both having substantially the same angle relative to the fin face.

7. The fin system as recited in claim 1, wherein at least one of said two blocks of louvers contains a breaking louver and a reversal louver both having substantially the same length as the main louver.

* * * * *